US005314611A

United States Patent [19]

Cetinkaya

[11] Patent Number: 5,314,611

[45] Date of Patent: * May 24, 1994

[54] EXTERNAL INTEGRATED DISENGAGER STRIPPER AND ITS USE IN FLUIDIZED CATALYTIC CRACKING PROCESS

[75] Inventor: Ismail B. Cetinkaya, Palatine, Ill.

[73] Assignee: UOP, Des Plaines, Ill.

[ * ] Notice: The portion of the term of this patent subsequent to Oct. 27, 2009 has been disclaimed.

[21] Appl. No.: 966,776

[22] Filed: Oct. 27, 1992

Related U.S. Application Data

[63] Continuation-in-part of Ser. No. 613,037, Nov. 15, 1990, Pat. No. 5,158,669.

[51] Int. Cl.[5] ..... C10G 11/18

[52] U.S. Cl. ..... 208/113; 208/152; 208/155; 208/161; 422/144; 422/145; 422/147

[58] Field of Search ..... 208/113, 152, 155, 161; 422/144, 145, 147

[56] References Cited

U.S. PATENT DOCUMENTS

| | | | |
|---|---|---|---|
| 2,440,620 | 4/1948 | Taff | 23/288 |
| 2,541,801 | 2/1951 | Wilcox | 196/52 |
| 2,612,438 | 9/1952 | Murphree | 23/288 |
| 2,994,659 | 8/1961 | Slyngstad et al. | 208/113 |
| 3,894,932 | 7/1975 | Owen | 208/74 |
| 4,364,905 | 12/1982 | Fahrig et al. | 422/144 |
| 4,414,100 | 11/1983 | Krug et al. | 208/153 |
| 4,481,103 | 11/1984 | Krambeck et al. | 208/120 |
| 4,500,423 | 2/1985 | Krug et al. | 208/161 |
| 4,623,446 | 11/1986 | Haddad et al. | 208/113 |
| 4,689,206 | 8/1987 | Owen et al. | 422/144 |
| 4,692,311 | 9/1987 | Parker et al. | 422/144 |
| 4,749,471 | 6/1988 | Kam et al. | 208/113 |
| 4,927,527 | 5/1990 | Haddad et al. | 208/161 |

*Primary Examiner*—Bernard Dentz

*Attorney, Agent, or Firm*—Thomas K. McBride; John G. Tolomei

[57] ABSTRACT

A method and apparatus for an FCC process uses dissipator plates at the outlet of a disengaging vessel to provide a quick separation of catalyst from product vapors and to prevent reentrainment of catalyst into the disengaging vessel. The process and apparatus use a riser for the conversion of an FCC feedstock and direct the effluent from the riser directly into a disengaging vessel to separate catalyst from the product vapors. Catalyst is directed downwardly out of the outlet of the disengaging vessel and through a series of dissipator plates that eliminate the tangential velocity that would be otherwise introduced by the vortex and would lead to reentrainment of catalyst. A stripping vessel is located immediately below the disengaging vessel outlet to receive catalyst as it leaves the dissipator plates. The apparatus and process are specifically suited for operation without a reactor vessel for containment of the disengaging vessel and cyclones.

24 Claims, 6 Drawing Sheets

EXTERNAL INTEGRATED DISENGAGER STRIPPER AND ITS USE IN FLUIDIZED CATALYTIC CRACKING PROCESS

CROSS-REFERENCE TO RELATED APPLICATIONS

This application is a continuation in part of U.S. Ser. No. 613,037 filed Nov. 15, 1990 which was issued as U.S. Pat. No. 5,158,669 on Oct. 27, 1992, the contents of which are hereby incorporated by reference.

BACKGROUND OF THE INVENTION

1. Field of the Invention

This invention relates generally to methods and apparatus for fluidized catalytic cracking (FCC) units. More specifically this invention relates to methods for separating catalyst from product vapors in an FCC downstream of a riser reaction zone.

2. Description of the Prior Art

The fluidized catalytic cracking of hydrocarbons is the main stay process for the production of gasoline and light hydrocarbon products from heavy hydrocarbons such as vacuum gas oils. Large hydrocarbon molecules associated with the heavy hydrocarbon feed are cracked to break large hydrocarbon chains thereby producing lighter hydrocarbons. These lighter hydrocarbons are recovered as product and can be used directly or further processed to raise the octane barrel yield relative to the heavy hydrocarbon feed.

The basic equipment or apparatus for the fluidized catalytic cracking of hydrocarbons has been in existence since the early 1940's. The basic component of the FCC process include a reactor, a regenerator and a catalyst stripper. The reactor includes a contact zone where the hydrocarbon feed is contacted with a particulate catalyst and a separation zone where product vapors from the cracking reaction are separated from the catalyst. Further product separation takes place in a catalyst stripper that receives catalyst from the separation zone and removes entrained hydrocarbons from the catalyst by countercurrent contact with steam or another stripping medium. The FCC process is carried out by contacting the starting material, whether it be vacuum gas oil, reduced crude or another source of relatively high boiling hydrocarbons with a catalyst made up of a finely divided or particulate solid material. The catalyst is transported like a fluid by passing gas or vapor through it at sufficient velocity to produce a desired regime of fluid transport. The contact of the oil with fluidized material catalyses the cracking reaction. During the cracking reaction coke is deposited on the catalyst.

Coke is comprised of hydrogen and carbon and can include other materials in trace quantities such as sulfur and metals that enter the process with the starting material. Coke interferes with the catalytic activity of the catalyst by blocking active sites on the catalyst surface where the cracking reactions take place. Catalyst is transferred from the stripper to a regenerator for purposes of removing the coke by oxidation with an oxygen-containing gas. An inventory of catalyst having a reduced coke content, relative to the catalyst in the stripper, hereinafter referred to as regenerated catalyst, is collected for return to the reaction zone. Oxidizing the coke from the catalyst surface releases a large amount of heat, a portion of which escapes the regenerator with gaseous products of coke oxidation generally referred to as flue gas. The balance of the heat leaves the regenerator with the regenerated catalyst. The fluidized catalyst is continuously circulated from the reaction zone to the regeneration zone and then again to the reaction zone. The fluidized catalyst, as well as providing a catalytic function, acts as a vehicle for the transfer of heat from zone to zone. Catalyst exiting the reaction zone is spoken of as being spent, i.e., partially deactivated by the deposition of coke upon the catalyst. Specific details of the various contact zones, regeneration zones, and stripping zones along with arrangements for conveying the catalyst between the various zones are well known to those skilled in the art.

The rate of conversion of the feedstock within the reaction zone is controlled by regulation of the temperature of the catalyst, activity of the catalyst, quantity of the catalyst (i.e., catalyst to oil ratio) and contact time between the catalyst and feedstock. The most common method of regulating the reaction temperature is by regulating the rate of circulation of catalyst from the regeneration zone to the reaction zone which simultaneously produces a variation in the catalyst to oil ratio as the reaction temperatures change. That is, if it is desired to increase the conversion rate an increase in the rate of flow of circulating fluid catalyst from the regenerator to the reactor is effected. Since the catalyst temperature in the regeneration zone is usually held at a relatively constant temperature, significantly higher than the reaction zone temperature, any increase in catalyst flux from the relatively hot regeneration zone to the reaction zone affects an increase in the reaction zone temperature.

The hydrocarbon product of the FCC reaction is recovered in vapor form and transferred to product recovery facilities. These facilities normally comprise a main column for cooling the hydrocarbon vapor from the reactor and recovering a series of heavy cracked products which usually include bottom materials, cycle oil, and heavy gasoline. Lighter materials from the main column enter a concentration section for further separation into additional product streams.

The catalyst particles employed in an FCC process have a large surface area, which is due to a great multitude of pores located in the particles. As a result, the catalytic materials regains hydrocarbons within their pores and upon the external surface of the catalyst. Although the quantity of hydrocarbon retained on each individual catalyst particle is very small, the large amount of catalyst and the high catalyst circulation rate which is typically used in a modern FCC process results in a significant quantity of hydrocarbons being withdrawn from the reaction zone with the catalyst.

Therefore, it is common practice to remove, or strip, hydrocarbons from spent catalyst prior to passing it into the regeneration zone. It is important to remove retained spent hydrocarbons from the spent catalyst for process and economic reasons. First, hydrocarbons that entered the regenerator increase its carbon-burning load and can result in excessive regenerator temperatures. Stripping hydrocarbons from the catalyst also allows recovery of the hydrocarbons as products. Avoiding the unnecessary burning of hydrocarbons is especially important during the processing of heavy (relatively high molecular weight) feedstocks, since processing these feedstocks increases the deposition of coke on the catalyst during the reaction (in comparison to the coking rate with light feedstocks) and raises the combustion load in the regeneration zone. Higher combustion loads lead to higher temperatures which at some point may damage the catalyst or exceed the metallurgical design limits of the regeneration apparatus.

The most common method of stripping the catalyst passes a stripping gas, usually steam, through a flowing stream of catalyst, countercurrent to its direction of flow. Such steam stripping operations, with varying degrees of efficiency, remove the hydrocarbon vapors which are entrained with the catalyst and hydrocarbons which are adsorbed on the catalyst. Contact of the catalyst with a stripping medium may be accomplished in a simple open vessel as demonstrated by U.S. Pat. No. 4,481,103.

The efficiency of catalyst stripping is increased by using vertically spaced baffles to cascade the catalyst from side to side as it moves down a stripping apparatus and countercurrently contacts a stripping medium. Moving the catalyst horizontally increases contact between the catalyst and the stripping medium so that more hydrocarbons are removed from the catalyst. In these arrangements, the catalyst is given a labyrinthine path through a series of baffles located at different levels. Catalyst and gas contact is increased by this arrangement that leaves no open vertical path of significant cross-section through the stripping apparatus. Further examples of these stripping devices for FCC units are shown in U.S. Pat. Nos. 2,440,620; 2,612,438; 3,894,932; 4,414,100; and 4,364,905. These references show the typical stripper arrangement having a stripper vessel, a series of baffles in the form of frusto-conical sections that direct the catalyst inwardly onto a baffle in a series of centrally located conical or frusto conical baffles that divert the catalyst outwardly onto the outer baffles. The stripping medium enters from below the lower baffle in the series and continues rising upward from the bottom of one baffle to the bottom of the next succeeding baffle. Variations in the baffles include the addition of skirts about the trailing edge of the baffle as depicted in U.S. Pat. No. 2,994,659 and the use of multiple linear baffle sections at different baffle levels as demonstrated by FIG. 3 of U.S. Pat. No. 4,500,423. A variation in introducing the stripping medium is shown in U.S. Pat. No. 2,541,801 where a quantity of fluidizing gas is admitted at a number of discrete locations.

As the development of FCC units has advanced, temperatures within the reaction zone were gradually raised. It is now commonplace to employ temperatures of about 525° C. At higher temperatures, there is generally a loss of gasoline components as these materials crack to lighter components by both catalytic and strictly thermal mechanisms. At 525° C., it is typical to have 1% of the potential gasoline components thermally cracked into lighter hydrocarbon gases. As temperatures increase, to say 550° C., most feedstocks can lose up to 6% or more of the gasoline components to thermal cracking. However, the loss of gasoline can be offset by the often more desirable production of light olefins.

One improvement to FCC units, that has reduced the product loss by thermal cracking, is the use of riser cracking. In riser cracking, regenerated catalyst and starting materials enter a pipe reactor and are transported upward by the expansion of the gases that result from the vaporization of the hydrocarbons, and other fluidizing mediums if present upon contact with the hot catalyst. Riser cracking provides good initial catalyst and oil contact and also allows the time of contact between the catalyst and oil to be more closely controlled by eliminating turbulence and backmixing that can vary the catalyst residence time. An average riser cracking zone today will have a catalyst to oil contact time of 1 to 5 seconds. A number of riser reaction zones use a lift gas as a further means of providing a uniform catalyst flow. Lift gas is used to accelerate catalyst in a first section of the riser before introduction of the feed and thereby reduces the turbulence which can vary the contact time between the catalyst and hydrocarbons.

In most reactor arrangements, catalysts and conversion products still enter a large chamber for the purpose of initially disengaging catalyst and hydrocarbons. The large open volume of the disengaging vessel exposes the hydrocarbon vapors to turbulence and backmixing that continues catalyst contact for varied amounts of time and keeps the hydrocarbon vapors at elevated temperatures for a variable and extended amount of time. Thus, thermal cracking can be a problem in the disengaging vessel. A final separation of the hydrocarbon vapors from the catalyst is performed by cyclone separators that use centripedal acceleration to disengage the heavier catalyst particles from the lighter vapors which are removed from the reaction zone.

In order to minimize thermal cracking in the disengaging vessel, a variety of systems for directly connecting the outlet of the riser reactor to the inlet of a cyclone are suggested in the prior art. A majority of the hydrocarbon vapors that contact the catalyst in the reaction zone are separated from the solid particles by ballistic and/or centrifugal separation methods within the reaction zone. Directly connecting the inlet of a first cyclone and the outlet the first cyclone to the inlet of a second cyclone in what has been termed a "direct connected cyclone system" can greatly reduce thermal cracking of hydrocarbons. Unfortunately in most cases direct connected cyclones will increase the complexity of operating an FCC unit. When the cyclones are directly connected to the riser any pressure surges that normally occur in the FCC unit can cause the cyclones to malfunction and lead to the carry-over of catalyst into the main column and separation facilities for the recovery of the product. A number of different riser and cyclone arrangements are shown in the prior art to increase the reliability of the cyclone operation when the riser is directly connected thereto.

One way in which to overcome the problem of pressure surges and catalyst carry over is to connect a separation device having a large capacity to the outlet of the riser. Such a separation device is shown in FIG. 8 of U.S. Pat. No. 4,689,206. This separation device provides a disengagement of the catalyst and product vapor mixture before the mixture enters the relatively small volume of an ordinary cyclone. Due to its large volume the separation device is not easily overloaded and ordinary pressure surges will not interrupt its operation. However such large separation devices suffer from low separation efficiencies that increase the particle load on the downstream cyclones or require the use of two stage cyclones or must have a relatively long length to provide a high separation efficiency. Reduced efficiencies are in large part caused by the reentrainment of catalyst particles with the gas as it flows out of the separation device.

DISCLOSURE STATEMENT

U.S. Pat. No. 4,692,311 issued to Parker et al. shows an apparatus for the separation of fluidized catalyst particles from gaseous hydrocarbons that comprises a cyclone zone having a tangential particle gas inlet and a vortex stabilizer in a lower section of the zone.

U.S. Pat. No. 4,689,206 issued to Owen et al. shows a separation device for an FCC reactor that is used at the end of a riser to impart a tangential velocity to catalyst particles that enter a confined separation zone. This reference also discloses the direct connection of the outlet from the confined separation zone to a cyclone separator.

U.S. Pat. No. 4,749,471 issued to Kam et al. discloses a direct connected cyclone system wherein an FCC riser reaction zone is directly connected to a first stage cyclone and transfers catalyst particles in close communication from the reactor riser to a first stage cyclone and from the first stage cyclone to a second stage cyclone from which product vapors are directly removed from the reactor.

U.S. Pat. No. 4,927,527 issued to Haddad et al. shows a combination separation and stripping device attached directly to a reactor riser, a mixture of gases and an FCC catalyst are transferred directly from the reactor riser and tangentially enter a separation device through which a stripping gas passes upwardly in countercurrent contact with the catalyst particles and from which stripping gas and vapors are withdrawn from a series of central openings.

U.S. Pat. No. 4,623,446 issued to Haddad et al. shows a direct connected cyclone system for an FCC reactor wherein stripping gas from the reactor vessel is vented into a conduit that directly connects a first stage or riser cyclone with a second stage cyclone.

It is an object of this invention to provide a catalyst separation system for use without a reactor vessel that will provide a quick disengagement between catalyst and product vapors and be simple and reliable to operate.

It is a further object of this invention to provide a disengaging system for reactor products and catalysts that is not susceptible to overload from pressure surges and has a compact design that does not require the use of a reactor vessel.

A further object of this invention is to provide a separation vessel that can receive the entire effluent from a reactor riser and provide a high separation efficiency without a susceptibility to overload from pressure surges.

A further object of this invention is to provide an FCC process that provides a quick separation of catalyst from product vapors and is not susceptible to overload from pressure surges or changes in operation of the reactor system.

BRIEF DESCRIPTION OF THE INVENTION

The objects of this invention are provided by a separation system that is directly connected to the outlet of the riser and provides a high degree of separation by using a centrifugal separation within a disengaging vessel and means for dissipating turbulent flow below the disengaging vessel to improve catalyst separation and prevent catalyst reentrainment. Partitions, or dissipators, located immediately below the outer vortex that is formed in most centrifugal particle separations, can provide the dissipating means. Ordinarily, a tangential velocity is introduced by the vortex, and if not dissipated will create turbulence that will reentrain free catalyst. Contact with the plates, or other device, dissipates these tangential velocities and reduces turbulence immediately below the vortex. The dissipator plates can also be arranged to trap catalyst particles as they fall from the vortex to reduce the particle velocity and prevent reentrainment.

Accordingly, in one embodiment, this invention is a fluid catalytic cracking apparatus that includes, a riser having an inlet end for receiving feed and catalyst and an outlet end. An elongated disengaging vessel has an upper end in direct communication with the outlet end of the riser and gas outlet. A lower end of the disengagement vessel has an open bottom wherein the outermost portion of the open bottom is unoccluded to permit unobstructed fluid and particulate flow. A stripping vessel is located directly below the disengaging vessel. The stripping vessel has an inlet that communicates directly with the open bottom of the disengaging vessel and an outlet for withdrawing catalyst from the stripping vessel. Means are provided for adding stripping gas to the stripping vessel. A segregation zone is located in the stripping vessel and includes means for dissipating turbulent flow below the disengaging vessel. In one arrangement this dissipation means takes the form of partitions or dissipators that are located immediately below the outer vortex that is formed in most cyclone operations and includes at least two vertical partition plates spaced below the open bottom of the disengaging vessel.

In a more limited embodiment, this invention comprises a fluid catalytic cracking apparatus that includes a tubular riser having an inlet end for receiving feed and catalyst and an outlet end. An elongated disengaging vessel has an upper end with a tangential inlet in direct communication with the outlet end of the riser and a central gas outlet at the top. The lower end has a vertically extending sidewall and an open bottom. A stripper vessel having an upper end into which the lower end of the disengaging vessel extends is located immediately below the disengaging vessel. At least two dissipator plates are located inside the stripper vessel. The dissipator plates extend inwardly from the walls of the stripper vessel with each dissipator plate lying in a common plane with the centerline of the stripper vessel. The dissipator plates have a central portion, the top of which is spaced below the lower end of the disengaging vessel. The stripper vessel also has a catalyst outlet at its lower end and at least one inner and at least one outer stripping baffle located between the top of the central portion of the dissipator plates and the catalyst outlet and means for introducing a stripping fluid into the stripping vessel. A vortex stabilizer extends into the lower end of the disengaging vessel.

In a yet more limited embodiment, this invention is a fluid catalytic cracking apparatus that includes a tubular riser having an inlet end for receiving feed and an outlet end. An elongated disengaging vessel has an upper end and a lower end. The upper end has a tangential inlet in direct communication with the outlet end of the riser and a central gas outlet at the top of the disengaging vessel. The lower end has a vertically extending sidewall and an open bottom. A stripper vessel having upper and lower sections is fixed to the lower end of the disengaging vessel. The upper section of the stripping vessel also has a larger diameter than the lower end of the disengaging vessel and at least two dissipator plates extending inwardly from the walls of the stripper vessel with each dissipator plate lying in a common plane with the centerline of the stripper vessel. The dissipator plates have a central portion spaced below the lower end of the disengaging vessel and an outer portion that extends vertically from the top of the central portion above the open bottom of the disengaging vessel. At least one stripping baffle is located at the bottom of the dissipator plates. The lower end of the stripping vessel lower section has a catalyst outlet and a distributor for adding stripping gas to the stripping vessel. The upper end of the lower section has at least one stripping baffle located therein. A vortex stabilizer extends into the lower end of the disengaging vessel. A cyclone separator receives product vapors and catalyst from the gas outlet of the disengaging vessel. The cyclone has a dip-leg that returns catalyst to the disengaging or the stripping vessel. A first conduit communicates product vapors directly from the gas outlet to the cyclone separator. A second conduit communicates product vapors from the cyclone to product recovery facilities.

In an alternate embodiment this invention is a process for the fluidized catalytic cracking of an FCC feedstream. The process includes the steps of passing an FCC catalyst and the FCC feedstream to a riser reaction zone and contacting the feedstream with the FCC catalyst in the riser reaction zone to convert the feedstream to product vapors, discharging a mixture of the product vapors and the spent FCC catalyst from the riser directly into a disengaging vessel, and directing the mixture tangentially into the top of the disengaging vessel to form an inner and outer vortex of product gases in the disengaging vessel, emptying catalyst particles from the bottom of the disengaging vessel directly into the top of a subadjacent stripping vessel. The process includes injecting a stripping gas into the stripping vessel and contacting the catalyst particles with the stripping gas to desorb hydrocarbons from the catalyst particles, discharging a gaseous stream of desorbed hydrocarbons and stripping gas upwardly through the stripping vessel and dissipating turbulence as the hydrocarbons and gas flow into the disengaging vessel through an open volume of the stripping vessel located below the bottom of the disengaging vessel and passing the hydrocarbons and gas out of the top of the stripping vessel and into the bottom of the Catalyst from disengaging vessel; maintaining a relatively dense bed of catalyst in the stripping vessel; withdrawing the product vapors and the gaseous stream from the top of the disengaging vessel through an outlet; passing the product vapor and the gaseous stream from the outlet to a separator to recover additional catalyst particles; recovering a product stream from the separator; transferring catalyst particles from the separator to the stripping vessel or disengaging vessel; removing spent catalyst from the lower end of the stripping vessel and transferring spent catalyst to a regeneration zone; regenerating the FCC catalyst in the regeneration zone by the oxidative removal of coke; and transferring FCC catalyst from the regeneration zone to the riser reaction zone.

Additional details and embodiments of this invention can be found in the following detailed description of the invention.

DETAILED DESCRIPTION OF THE INVENTION

Figure 1:
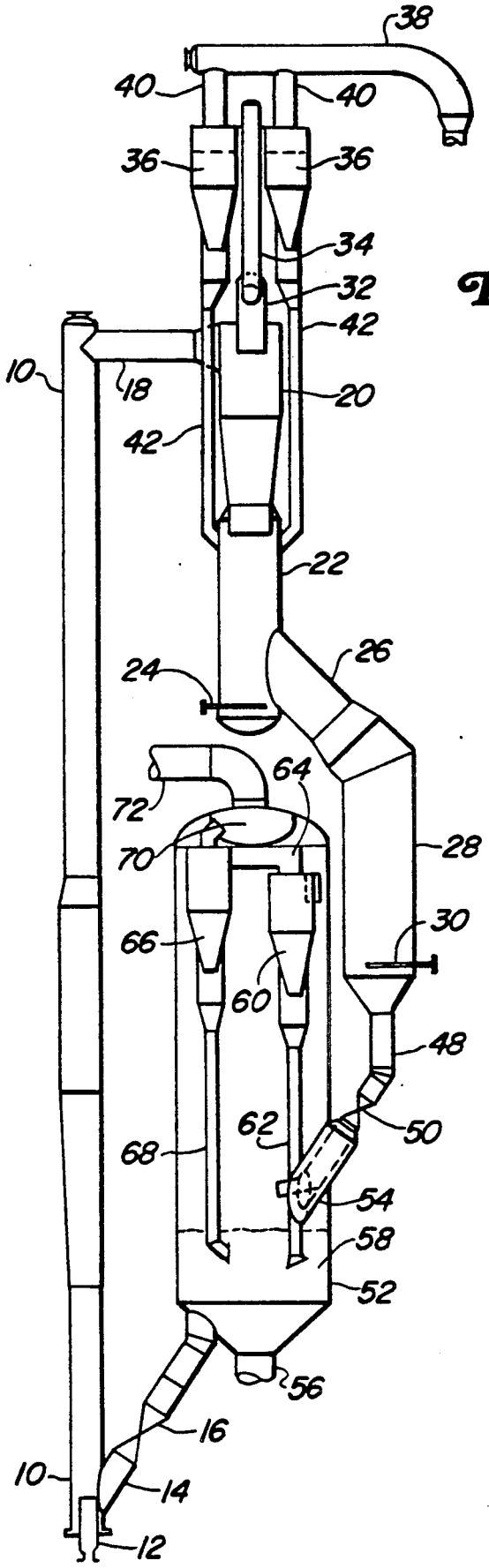
FIG. 1 is a sectional elevation of a reactor riser, disengaging vessel, stripping vessel and regenerator arrangement that incorporates the separation system of this invention.

Looking first at a more complete description of the FCC process, the typical feed to an FCC unit is a gas oil such as a light or vacuum gas oil. Other petroleum-derived feed streams to an FCC unit may comprise a diesel boiling range mixture of hydrocarbons or heavier hydrocarbons such as reduced crude oils. It is preferred that the feed stream consist of a mixture of hydrocarbons having boiling points, as determined by the appropriate ASTM test method, above about 230° C. and more preferably above about 290° C. It is becoming customary to refer to FCC type units which are processing heavier feedstocks, such as atmospheric reduced crudes, as residual crude cracking units, or residual cracking units. The process and apparatus of this invention can be used for either FCC or residual cracking operations. For convenience, the remainder of this specification will only make reference to the FCC process.

The chemical composition and structure of the feed to an FCC unit will affect the amount of coke deposited upon the catalyst in the reaction zone. Normally, the higher the molecular weight, Conradson carbon, heptane insolubles, and carbon/hydrogen ratio of the feedstock, the higher will be the coke level on the spent catalyst. Also, high levels of combined nitrogen, such as found in shale-derived oils, will increase the coke level on spent catalyst. Processing of heavier feedstocks, such as deasphalted oils or atmospheric bottoms from a crude oil fractionation unit (commonly referred to as reduced crude) results in an increase in some or all of these factors and therefore causes an increase in the coke level on spent catalyst. As used herein, the term "spent catalyst" is intended to indicate catalyst employed in the reaction zone which is being transferred to the regeneration zone for the removal of coke deposits. The term is not intended to be indicative of a total lack of catalytic activity by the catalyst particles.

The reaction zone, which is normally referred to as a "riser", due to the widespread use of a vertical tubular conduit, is maintained at high temperature conditions which generally include a temperature above about 427° C. Preferably, the reaction zone is maintained at cracking conditions which include a temperature of from about 480° C. to about 590° C. and a pressure of from about 65 to 500 kPa (ga) but preferably less than about 275 kPa (ga). The catalyst/oil ratio, based on the weight of catalyst and feed hydrocarbons entering the bottom of the riser, may range up to 20:1 but is preferably between about 4:1 and about 10:1. Hydrogen is not normally added to the riser, although hydrogen addition is known in the art. On occasion, steam may be passed into the riser. The average residence time of catalyst in the riser is preferably less than about 5 seconds. The type of catalyst employed in the process may be chosen from a variety of commercially available catalysts. A catalyst comprising a zeolitic base material is preferred, but the older style amorphous catalyst can be used if desired. Further information on the operation of FCC reaction zones may be obtained from U.S. Pat. Nos. 4,541,922 and 4,541,923 and the patents cited above.

As previously mentioned an FCC process unit comprises a reaction zone and a catalyst regeneration zone. This invention may be applied to any configuration of reactor and regeneration zone that uses a riser for the conversion of feed by contact with a finely divided fluidized catalyst maintained at an elevated temperature and at a moderate positive pressure. In this invention, contacting of catalyst with feed and conversion of feed takes place in the riser. The riser comprises a principally vertical conduit and the effluent of the conduit empties into a disengaging vessel. One or more additional solids-vapor separation devices, almost invariably a cyclone separator normally receives the effluent from the disengager vessel. The disengager vessel and cyclone separate the reaction products from a portion of catalyst which is still carried by the vapor stream. One or more conduits vent the vapor from the cyclone and separation zone. After initial separation the spent catalyst passes through a stripping zone that is located directly beneath the disengaging vessel. It is essential to this invention that the stripping vessel is located below the disengaging zone and that the upper portion of the stripping vessel contain means for dissipating turbulence at the outlet of the disengaging vessel. After the catalyst has passed through the stripping zone it can be transferred to the regenerator vessel or pass through one or more additional stages of stripping.

Once stripped, catalyst flows to a regeneration zone. In an FCC process, catalyst is continuously circulated from the reaction zone to the regeneration zone and then again to the reaction zone. The catalyst therefore acts as a vehicle for the transfer of heat from zone to zone as well as providing the necessary catalytic activity. Catalyst which is being withdrawn from the regeneration zone is referred to as "regenerated" catalyst. As previously described, the catalyst charged to the regeneration zone is brought into contact with an oxygen-containing gas such as air or oxygen-enriched air under conditions which result in combustion of the coke. This results in an increase in the temperature of the catalyst and the generation of a large amount of hot gas which is removed from the regeneration zone and referred to as a flue gas stream. The regeneration zone is normally operated at a temperature of from about 600° C. to about 800° C. Additional information on the operation of FCC reaction and regeneration zones may be obtained from U.S. Pat. Nos. 4,431,749; 4,419,221 (cited above); and 4,220,623.

The catalyst regeneration zone is preferably operated at a pressure of from about 35 to 500 kPa (ga). The spent catalyst being charged to the regeneration zone may contain from about 0.2 to about 5 wt. % coke. This coke is predominantly comprised of carbon and can contain from about 3 to 15 wt. % hydrogen, as well as sulfur and other elements. The oxidation of coke will produce the common combustion products: carbon dioxide, carbon monoxide, and water. As known to those skilled in the art, the regeneration zone may take several configurations, with regeneration being performed in one or more stages. Further variety in the operation of the regeneration zone is possible by regenerating fluidized catalyst in a dilute phase or a dense phase. The term "dilute phase" is intended to indicate a catalyst/gas mixture having a density of less than 320 kg/m$^3$. In a similar manner, the term "dense phase" is intended to mean that the catalyst/gas mixture has a density equal to or more than 320 kg/m$^3$. Representative dilute phase operating conditions often include a catalyst/gas mixture having a density of about 15 to 150 kg/m$^3$.

FIG. 1 shows an FCC reactor riser, disengager stripper and regenerator arranged to incorporate the separation system of this invention. In its basic operation, feed enters the lower end of a riser 10 through a nozzle 12 where it is contacted with fresh regenerated catalyst from a regenerated catalyst conduit 14. A valve 16 controls the rate of catalyst addition to riser 10. Steam may also be added with the feed through nozzle 12 in order to achieve the desired feed velocity and help the dispersion of feed into the stream of catalyst particles. Feed hydrocarbons are cracked by contact with the catalyst in the riser and spent catalyst and product vapors exit the upper end of riser 10 through a horizontal pipe section 18. Pipe section 18 discharges the catalyst and product vapor mixture directly into a disengaging vessel 20. Catalyst disengaged from the product vapors in disengager 20 pass downwardly into a stripping vessel 22. Steam entering stripping vessel 22 through a nozzle 24 countercurrently contacts catalyst particles to strip additional hydrocarbons from the catalyst. Catalyst exits stripping vessel 22 through nozzle 26 and enters a second catalyst stripper 28. Steam entering stripping vessel 28 through nozzle 30 again countercurrently contacts the catalyst particles to remove additional hydrocarbons from the catalyst. Stripping gas and separated hydrocarbons rise upwardly through stripping vessels 28 and 22 and are withdrawn in a manner hereinafter more fully described through disengaging vessel 20 and a gas outlet 32 that is preferably centered in the disengaging vessel. A manifold 34 conducts stripping fluid and product vapors into cyclones 36 that effect a further separation of catalyst particles from the stripping fluid and product vapors. A manifold 38 collects stripping fluid and product vapors from the cyclone 36 which are removed from the reactor vessel by conduits 40. Product vapor and stripping fluid are taken from manifold 38 to product separation facilities of the type normally used for the recovery of FCC products.

All of the spent catalyst from the reactor section is directed into the regenerator. Spent catalyst collected by cyclones 36 drops downwardly through dip-legs 42 and collects in stripping vessel 22. It is also possible to transfer catalyst from dip-legs 42 into the disengaging vessel. Spent catalyst stripped of hydrocarbons is withdrawn from the bottom of vessel 28 through spent catalyst conduit 48 at a rate regulated by control valve 50.

In a regenerator 52 the catalyst is regenerated by oxidizing coke from the surface of the catalyst particles and generating flue gas that contains $H_2O$, CO and $CO_2$ as the products of combustion. The catalyst enters regenerator 52 through a nozzle 54 and is contacted with air entering the regeneration vessel through a nozzle 56. This invention does not require a specific type of regeneration system. The regeneration vessel pictured in FIG. 52 ordinarily operates with a dense bed 58 in its lower section. Some form of distribution device across the bottom of the regeneration vessel distributes air over the entire cross-section of the vessel. A variety of such distribution devices are well known to those skilled in the art. Alternatively, this invention can be practiced with a regeneration zone that provides multiple stages of coke combustion. Furthermore, the regeneration zone can achieve complete CO combustion or partial CO combustion. In the dense bed operation, as depicted in FIG. 1, flue gas and entrained catalyst particles rise up from bed 58. A first stage cyclone 60 collects flue gas and performs an initial separation of the catalyst particles which are returned to bed 58 by dip-leg 62 and the flue gas which is transferred by a conduit 64 to a second cyclone 66. A further separation of catalyst from the flue gas takes place in cyclones 66 with the catalyst particles returning to bed 58 via a dip-leg 68 and the flue gas leaving the upper end of cyclone 66 and the regeneration vessel via a collection chamber 70 and a flue gas conduit 72.

The stripping vessel and the disengaging vessel may be supported from regenerator vessel or from an independent structure. Since there is no reactor vessel for containment a structure is ordinarily necessary for support of the stripping vessel, disengaging vessel, cyclones and other piping. Design of the FCC arrangement of this invention will also require the use of expansion joint elements in the piping to accommodate thermal expansion of the system. The design of such a supporting structure and expansion joint elements is well known to those skilled in the art and represent only a fraction of the cost required to provide a reactor vessel.

Figure 2:
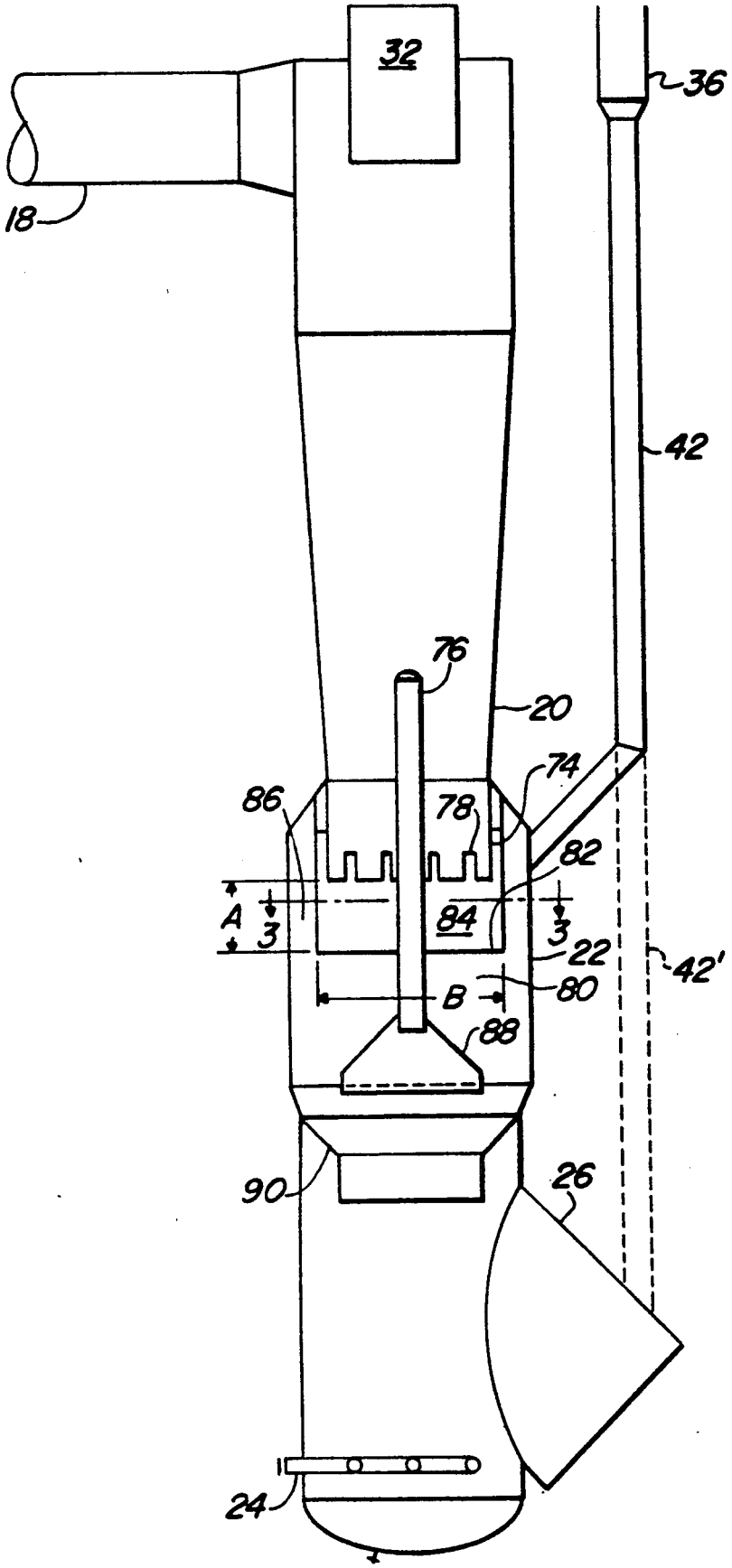
FIG. 2 is an enlarged detail of the disengaging vessel and stripping vessel of FIG. 1.

A more complete understanding of the operation and arrangement of disengaging vessel 20 and stripping vessel 22 is obtained by reference to FIG. 2. Disengaging vessel 20 operates with the mixture of spent catalyst and product vapors entering the upper end of disengaging vessel 20 tangentially through horizontal conduit 18. Tangential entry of the gases and solids into disengaging vessel 20 forms the well-known double helix flow pattern through the disengaging vessel that is typically found in the operation of traditional cyclones. Catalyst and gas swirls downwardly in the first helix near the outer wall of vessel 20 and starts back upwardly as an inner helix that spirals through the center of disengaging vessel 20 and exits the top of the disengaging vessel through central gas outlet 32. The spinning action of the gas and catalyst mixture concentrates the solid particles near the wall of vessel 20. Gravity pulls the particles downward along the wall of vessel 20 and out through a lower outlet 74. The efficiency of the disengager is improved by controlling the positioning of the double helix with a vortex stabilizer 76 that is located in the center of disengaging vessel 20. More than 95% of the solids passing through conduit 18 are removed by disengaging vessel 20 so that the gas stream that exits through conduit 32 contains only a light loading of catalyst particles. The vortex shape is also enhanced by giving disengaging vessel 20 a slight frustoconical shape such that the upper section has a larger diameter than the lower section. It is also preferred that disengaging vessel 20 be designed such that the bottom of the outer helix ends at or about the bottom of opening 74. This design differs from traditional cyclones which are designed such that they will have a much longer length than the outer helix length. The required space for disengaging vessel 20 has been reduced by designing it such that the bottom of the outer helix extends to or only slightly below the outlet 74. The length of the disengager required for a specific helix configuration will depend on its size and the gas velocity. For disengagers of average size, those ranging from 5 to 10 feet in diameter, the length of the disengager from the bottom of the gas and catalyst inlet to the outlet 74 will be 2 to 3 times the largest diameter of the disengaging vessel.

As the solids leave disengaging vessel 20 through outlet 74, it tends to be reentrained by gas that is circulating near opening 74 or entering disengaging vessel 20 through opening 74. Locating the outlet 74 near the bottom of the outer helix of the disengaging vessel can create turbulence that will reentrain additional catalyst. Stripping gas and stripped hydrocarbons flowing upwardly from the stripping vessel into the disengaging vessel can also reentrain catalyst particles. In one embodiment of this invention, a portion of catalyst particles exit outlet 74 radially through a series of slots or ports 78 that extend circumferentially around the lower portion of outlet 74. Typically, the outlet will have 8 to 24 of such slots spaced around the outside. These slots will usually vary from 12 to 24 inches in height and approximately 3 to 6 inches in width. The slots improve the separation efficiency by containing the vortex that is near the outlet 74 while allowing catalyst particles to spray outwardly under the influence of the vortex into the outer portion of stripping vessel 22, thereby clearing the central portion of outlet 74 for the influx of gas.

Disengaging vessel 20 opens directly into the top of stripping vessel 22. Swirling gas flow associated with the cyclonic vortex and the countercurrent flow of gas upwardly from the stripping vessel 22 normally would create a long zone of turbulence below outlet 74. The effect of any turbulence is reduced by providing means for dissipating the turbulence below the disengaging vessel. FIG. 2 show one means of dissipating turbulence below the disengaging vessel in the form of a set of plates 80 that function to dissipate any turbulence associated with the swirling action of the helical gas flows. Other means for dissipating turbulence include a helical trap consisting of means for impacting catalyst particles and directing them downward. Referring again to FIG. 2, the dissipator plates are spaced below the bottom of opening 74 such that an open area 84 provided between the top 82 of the central portion of the dissipator or partition plates 80, and the bottom of outlet 74. The length of this space is indicated by Dimension A and will preferably be equal to approximately half the diameter of the outlet 74. This space is provided above the top 82 of plates 80 and is not brought all the way up to the bottom of opening 74 in order to reduce the velocity of the descending vortex before it contacts the dissipator plates. In an alternate arrangement, the tops of plates 80 may be sloped along lines 82'. In a yet further arrangement, the means for dissipating turbulence can consist of several radially spaced vanes extending from a central support such as vortex stabilizer 76.

The dissipator plates 80 are attached to the inner walls of stripper 22 and extend inwardly to the center line of vessel 22. Plates 80 can have a slanted or spiral arrangement, but are preferably arranged vertically. In most cases at least four dissipator plates will extend inwardly from the walls of vessel 22 and divide the cross-section of the stripper vessel in the region of the dissipator plates into four quadrants. Plates 80 dissipate any horizontal components of gas flow that extend below the open area 84. The plates 80 also provide a convenient means of locating and supporting vortex stabilizer 76 and stripper baffle 88. The vertical extending portion of plates 80 obstruct any tangential or horizontal components of gas velocity such that the effects of any vortex does not extend past upper plate section 82. In addition, the horizontal momentum of any catalyst particles that extend below plate boundary 82 is stopped by plates 80 so that the particles have a more direct downward trajectory and the total distance traveled by the particles through the stripping vessel is reduced. Reducing the travel path of the particles through stripping vessel 22 lessens the tendency of catalyst reentrainment. In a preferred arrangement, at least one dissipator plate bisects the cross-section of the stripping vessel 22. At minimum, the Diameter B of the dissipator plates about the central portion 82 should be at least equal to the diameter of outlet 74. The effectiveness of the dissipator plates is increased by having the Diameter B at least slightly larger than the diameter of outlet 74. The stripping vessel can be arranged such that its outer wall has a diameter equal to Dimension B. The effectiveness of the dissipator plates can be further increased by increasing the diameter of stripping vessel 22 relative to Dimension B and providing the dissipator plates with an outer section 86 that extends outwardly to the region beyond Dimension B and above the central portion 82 of the plates. Outer section 86 preferably extends above outlet 74 and more preferably above the top of slots 78. The additional plate area provided by sections 86 of the dissipator plates 80 serves to further reduce tangential gas velocity components and moreover to provide a relatively stagnant area for collecting catalyst particles that accumulate on the outside wall of stripper vessel 22. Plate sections 86 function to further direct catalyst particles, that would otherwise become entrained in the upflowing stripping gas and swirling gas associated with the cyclonic separation, to flow downwardly into the stripping vessel.

As the catalyst flows downwardly, it is countercurrently contacted with the stripping gas from nozzle 24. In order to improve the stripping efficiency, conical baffles are provided to increase the contact between the solid particles and the stripping gas in the middle or lower sections of the stripping vessel. These stripping baffles have the usual cone arrangement that is ordinarily found in FCC strippers. In one particular arrangement, an uppermost inner cone type baffle 88 is attached to partition plates 80 and a lower frusto-conical section 90 is attached to the wall of stripping vessel 22. These baffles can be of any ordinary design well known to those skilled in the art and commonly used in FCC strippers. Preferably, the stripper baffles will be provided with skirts that depend downwardly from the lower conical portion of the baffle. It is also known that such skirts can be perforated to increase the contacting efficiency between the stripping fluid and the catalyst particles. At the bottom of the stripping vessel a nozzle 26 withdraws spent catalyst.

Figure 3:
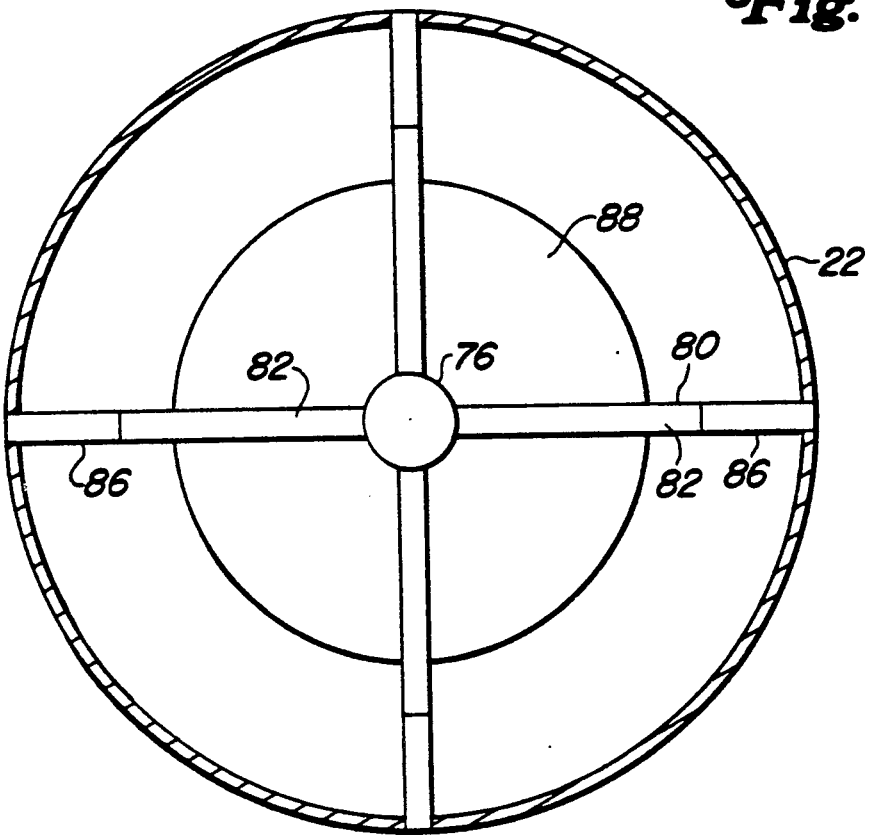
FIG. 3 is a section of the enlarged separation section taken across lines 3/3 of FIG. 2.

FIG. 3 depicts the dissipator plates 80 and upper stripper baffle 88 in plan view. Looking at FIG. 3, four dissipator plates 80 having central top surfaces 82 are shown spaced 90° apart and extending from the outer wall of the upper stripper section 22 to the outside of vortex stabilizer 76. Vortex stabilizer 76 is centrally supported from the dissipator plates. The outer portion of plates 80 include the side portion 86 of the plates.

In addition to catalyst from disengager 20, catalyst from dip-leg 42 returns catalyst from cyclone 36 to one of the disengaging vessel or a stripping zone. FIG. 2 depicts the preferred configuration where catalyst from cyclone 36 empties into stripping vessel 22. Most preferably the catalyst from dip-leg will enter the relatively stagnant area formed by section 86 of the partition plates. In other embodiments catalyst from dip-leg 42 may by pass stripping vessel 22 altogether and flow directly into an additional stage of downstream stripping via alternate dip-leg configuration 42'.

Figure 4:
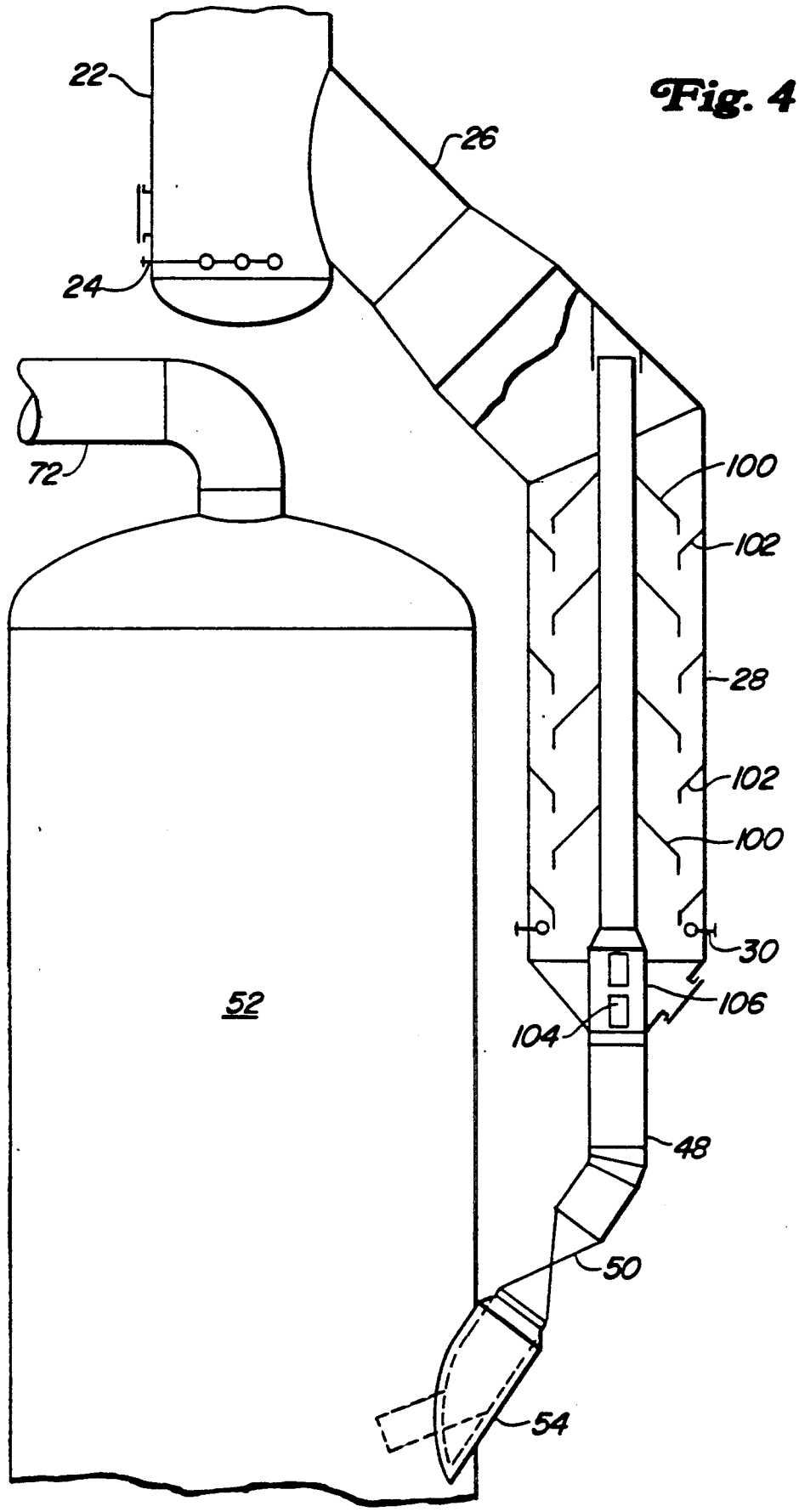
FIG. 4 is a detailed cross-section of a secondary stripper section shown in FIG. 1.

Catalyst that leaves the stripping vessel through nozzle 26 and enters and additional stage of stripping provided by the secondary stripping vessel 28. Stripping vessel 28, shown in more detail by FIG. 4, operates in a conventional manner. Catalyst passes downwardly through the stripper and is cascaded side to side through a series of inner baffles 100 and outer baffles 102. Catalyst is withdrawn through ports 104 in a lower portion of a support conduit 106 to which inner stripper baffles 100 are attached. Ports 104 direct the catalyst into conduit 48 for transfer into regenerator vessel 52 in the manner previously described. Stripping baffles 100 and 102 may again be provided with dependent skirts and orifices to increase the contact between catalyst and steam that enters the stripping vessel through nozzle 30. Steam or other stripping fluid that contacts the spent catalyst, rises countercurrently to the catalyst and flows out of stripping vessel 28 through nozzle 26.

Figure 5:
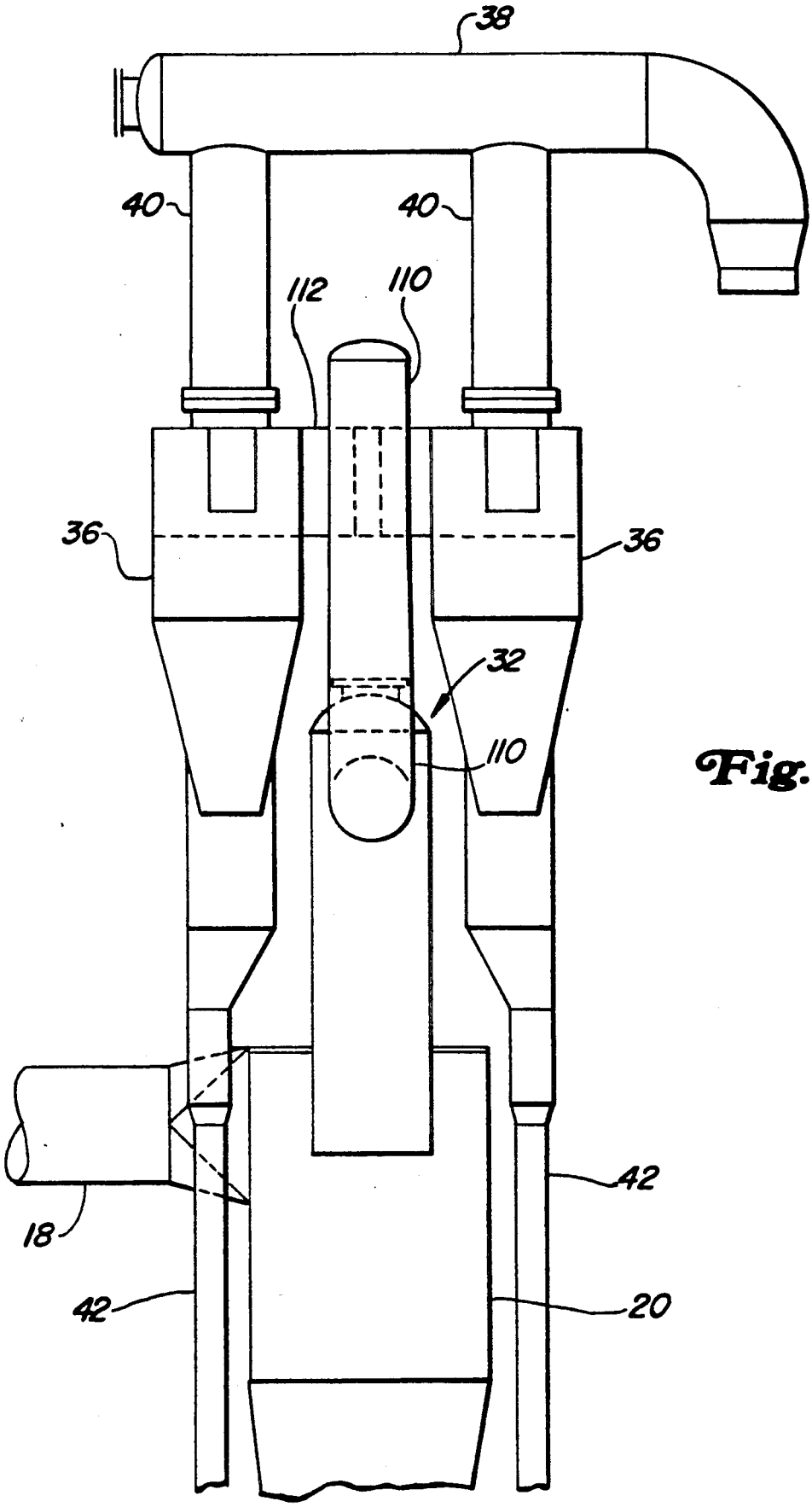
FIG. 5 is an enlarged view of the upper section of the disengaging vessel and separators shown in FIG. 1.

All of the stripping steam as well as displaced hydrocarbons flow upwardly through the upper stripping vessel and into the disengaging vessel where they are withdrawn with product vapors through the central gas tube 32. FIG. 5 shows the upper portion disengaging vessel 20 and cyclones 36. Central gas nozzle 32 extends upwardly and branches into a manifold that provides transfer conduits in the form of arms 110. Each of arms 110 is connected to a cyclone inlet 112 for cyclones 36. Transfer conduits 40 conduct product vapors, relatively free of catalyst, into manifold 38.

Figure 6:
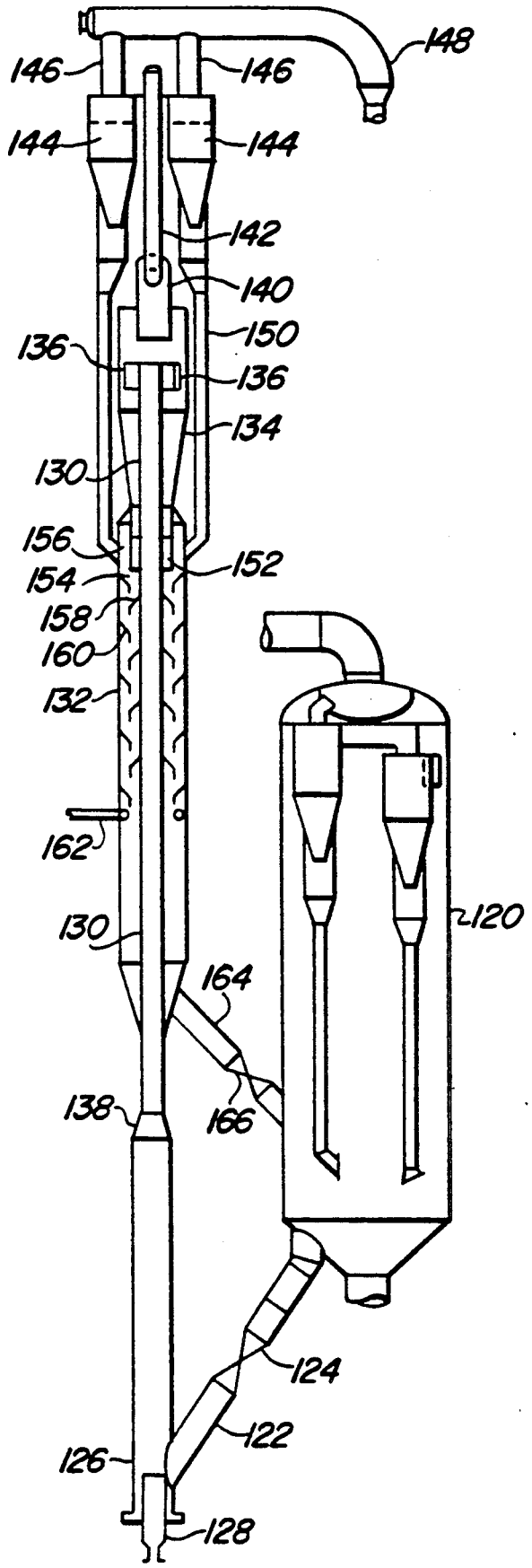
FIG. 6 is a sectional elevation of an alternate arrangement for the riser, disengager vessel, stripping vessel, and regenerator of this invention.

In another embodiment the disengaging vessel and stripping vessel of this invention has an arrangement that uses a central riser and a single stripping zone in a configuration that has the regeneration vessel to the side of the stripping vessel and disengaging vessel. FIG. 6 illustrates this arrangement wherein a regeneration vessel 120 supplies regenerated catalyst in the same manner as previously described for regeneration vessel 52 of FIG. 1 via a nozzle 122 at a rate regulated by a controlled valve 124. The regenerated catalyst contacts feed injected into a riser 126 by a nozzle 128. Feed reacts with the hot catalyst as it travels up external riser portion 126 and through internal riser portion 130. Internal riser section 130 passes concentrically through a stripping vessel 132 and a disengaging vessel 134. The top of riser 132 terminates with a pair of ducts 136 that tangentially direct the catalyst and hydrocarbon vapors into the upper portion of disengaging vessel 134. Tangentially directing the catalyst again forms a double helix in disengaging vessel 134 which serves to separate catalyst from the vapors. In order to minimize interference with the inner, helix ducts 136 may have a spiral form that further accommodates the helical flow of catalyst around the riser and ducts. Separated hydrocarbon vapors along with stripping fluid from stripping vessel 132 are collected by a central outlet tube 140 and passed through a manifold 142, cyclones 144, outlet tubes 146, and manifold 148 in the manner previously described to provide a relatively catalyst-free stream of product vapors taken from manifold 148.

Catalyst from disengaging vessel 136 along with catalyst from dip-legs 150 of cyclones 144 enter the top of stripping vessel 132. Catalyst from the disengaging vessel falls through an open section 152 before contacting dissipator plates 154. Catalyst from dip-legs 150 enters the top of the stripper at a relatively stagnant area formed by an outer portion 156 of dissipator plates 154.

Catalyst drops below the dissipator plates and cascades back and forth through a series of inner baffles 158 attached to riser section 130 and outer baffles 160 attached to the wall of stripping vessel 132. The downwardly cascading catalyst countercurrently contacts upwardly rising steam that enters stripper 132 through a distributor ring 162. Stripped catalyst from stripper 132 flows through a spent catalyst conduit 164 and enters regeneration vessel 120 at a rate regulated by a control valve 166.

The description of this invention in the context of specific embodiments is not meant to limit the invention to the details disclosed herein.

What is claimed is:

1. A fluid catalytic cracking apparatus comprising:

(a) a tubular riser having an inlet end for receiving feed and catalyst and an outlet end;

(b) an elongated disengaging vessel having an upper end and a lower end, means for tangentially directing the outlet end of said riser into an upper end of said disengaging vessel, and a gas outlet at the top of said disengaging vessel, said lower end of said disengaging vessel having an open bottom wherein the outermost portion of said open bottom is unoccluded to permit unobstructed fluid and particulate flow;

(c) a stripping vessel located directly below said disengaging vessel, said stripping vessel having an inlet in open communication with said open bottom of said disengaging vessel and an outlet for withdrawing catalyst from the stripping vessel;

(d) means for adding stripping gas to said stripping vessel; and, (f) a segregation zone located in said stripping vessel comprising means for dissipating turbulent flow below said open bottom of said disengaging vessel.

2. The apparatus of claim 1 wherein a vortex stabilizer tube extends upward from said open bottom into said disengagement vessel.

3. The apparatus of claim 2 wherein the diameter of said vortex stabilizer is less than 20% of the diameter of the open bottom and said open bottom is unoccluded except for said vortex stabilizer.

4. The apparatus of claim 1 wherein said means for dissipating turbulent flow comprises partition plates and said vertical plates extend horizontally and vertically and border an unobstructed area located immediately below said open bottom of said disengaging vessel.

5. The apparatus of claim 4 wherein said stripper vessel has a larger diameter than the bottom of said disengaging vessel, said vertical plates extend from the wall of said stripping inwardly to define at least two circumferentially extended chambers located below and to the outside of said open bottom of said disengaging vessel.

6. The apparatus of claim 4 wherein the portion of the partition plates located below the open bottom of said disengaging vessel are spaced below the open bottom by a distance equal to at least 25% of the diameter of said open bottom.

7. The apparatus of claim 4 wherein at least one inner stripping baffle and one outer stripping baffle are located in said stripping vessel below the top of said partition plates.

8. The apparatus of claim 1 wherein said gas outlet communicates with at least one cyclone, said cyclone has a dip-leg for returning catalyst to at least one of said disengaging vessel and said stripping vessel, and a vapor outlet for discharging a vapor product stream.

9. The apparatus of claim 8 wherein said dip-legs communicate with said stripping vessel.

10. The apparatus of claim 5 wherein said dip-legs communicate with said circumferentially extended chambers of said stripping vessel.

11. A fluid catalytic cracking apparatus comprising:

(a) a tubular riser having an inlet end for receiving feed and catalyst and an outlet end;

(b) an elongated disengaging vessel having an upper end and a lower end, said upper end having a tangential inlet in direct communication with said outlet end of said riser and a central gas outlet at the top of said disengaging vessel and said lower end having a vertically extending sidewall and an open bottom;

(c) a stripper vessel having an upper end into which said lower end of said disengaging vessel extends, at least two dissipator plates extending inwardly from the walls of said stripper vessel with each dissipator plate lying in a common plane with the centerline of said stripper vessel, said dissipator plates having a central portion, with the top of said central portion spaced below said lower end of said disengaging vessel, a catalyst outlet in the lower end of said stripper vessel, at least one inner stripping baffle and at least one outer stripping baffle located between the top of said central portion of said dissipator plates and said catalyst outlet, and means for introducing a stripping fluid into said stripping vessel;

(d) a vortex stabilizer extending into the lower end of said disengaging vessel; and, (e) a transfer conduit communicating said gas outlet with a cyclone separator, said cyclone separator having a dip-leg that returns catalyst from said cyclone separator to said stripping vessel.

12. The apparatus of claim 11 wherein said stripping vessel has a larger diameter than said disengaging vessel and said dissipator plates have an outer portion that extends up the sides of said stripping vessel to at least the bottom of said lower end of said disengaging vessel to provide circumferentially extended chambers.

13. The apparatus of claim 11 wherein said stripping vessel includes at least four levels of stripping baffles.

14. The apparatus of claim 12 wherein said dip-leg transfers catalyst from the cyclones to said circumferentially extended chamber.

15. The apparatus of claim 14 wherein said riser is external to said disengaging vessel and said stripping vessel.

16. The apparatus of claim 11 wherein said transfer conduit comprises a central header in direct communication with said gas outlet and a pair of symmetrical branch conduits extending radially outward from said central header and upwardly into communication with a pair of cyclone separators.

17. A fluid catalytic cracking apparatus comprising:

(a) a tubular riser having an inlet end for receiving feed and catalyst and an outlet end;

(b) an elongated disengaging vessel having an upper end and a lower end, said upper end having a tangential inlet in direct communication with said outlet end of said riser and a central gas outlet at the top of said disengaging vessel and said lower end having a vertically extending sidewall, an open bottom and a plurality of circumferentially spaced slots bordering the bottom of said vertically extending sidewall;

(c) a stripper vessel having an upper section fixed to the lower end of said disengaging vessel, said stripping vessel including;

(i) a larger diameter than the lower end of said disengaging vessel, at least two levels of stripping baffles, and at least two dissipator plates extending inwardly from the walls of said stripper vessel with each dissipator plate lying in a common plane with the centerline of said stripper vessel, said dissipator plates having a central portion that extends past the outside of said open bottom of said disengaging vessel with the top of said central portion spaced below said lower end of said disengaging vessel and an outer portion that extends vertically from the top of said central portion above said open bottom of said disengaging vessel, and at least one stripping baffle located at the bottom of said dissipator plates;

(ii) a lower section of said stripping vessel having a catalyst outlet and a distributor for adding stripping gas to said stripper vessel; and, (iii) a vortex stabilizer extending into the lower end of said disengaging vessel;

(d) a cyclone separator for receiving product vapors and catalyst from said gas outlet, said cyclone having a dip-leg that returns catalyst to said upper section of said stripping vessel;

(e) a first conduit communicating product vapors directly from said gas outlet to said cyclone separator; and, (f) a second conduit for communicating product vapors from said cyclone and to product recovery facilities.

18. A process for the fluidized catalytic cracking (FCC) of an FCC feedstream, said process comprising:

(a) passing FCC catalyst and said FCC feedstream to a riser reaction zone and contacting said feedstream with said FCC catalyst in said riser reaction zone to convert said feedstream to product vapors;

(b) discharging a mixture of said product vapors and spent FCC catalyst from said riser directly into a disengaging vessel and directing said mixture tangentially into said disengaging vessel to form at least an outer vortex in said disengaging vessel;

(c) emptying catalyst particles in closed communication from the bottom of said disengaging vessel directly into the top of a subadjacent stripping vessel;

(d) injecting a stripping gas into said stripping vessel and contacting said catalyst particles with said stripping gas to desorb hydrocarbons from said catalyst particles;

(e) discharging a gaseous stream of desorbed hydrocarbons and stripping gas upwardly from said stripping vessel, dissipating the turbulent flow of fluid and catalyst particles at the top of said stripping vessel, and passing said desorbed hydrocarbons and stripping gas out of the top of said stripping vessel and into the bottom of said disengaging vessel;

(f) maintaining a relatively dense bed of catalyst below the top of said stripping vessel;

(g) withdrawing said product vapors and said gaseous stream from the top of said disengaging vessel through an outlet;

(h) passing said product vapor and said gaseous stream from said outlet to a separator to recover additional catalyst particles;

(i) recovering a product stream from said separator;

(j) transferring catalyst particles from said separator to said stripping vessel;

(k) removing spent FCC catalyst from the lower end of said stripping vessel and transferring said spent catalyst to a regeneration zone;

(l) regenerating said FCC catalyst in said regeneration zone by the oxidative removal of coke; and, (m) transferring FCC catalyst from said regeneration zone to said riser reaction zone.

19. The process of claim 18 wherein said outer vortex extends to the bottom of said disengaging vessel.

20. The process of claim 18 wherein catalyst particles flow out vertically and radially from the lower end of said disengaging vessel through a plurality of slots located in the lower end of said disengaging vessel.

21. The process of claim 18 wherein a plurality of dissipator plates dissipate turbulent flow at the top of said disengaging vessel and said dissipator plates have side portions that extend up to the opening of said disengagement vessel and said dissipator plates and the wall of said stripping vessel define a plurality of chambers that collect at least a portion of the catalyst particles emptying from said disengaging vessel.

22. The process of claim 18 wherein a vortex stabilizer extends upwardly from the bottom of said disengaging vessel.

23. The process of claim 22 wherein said vortex stabilizer comprises a portion of a riser conduit.

24. The process of claim 18 wherein said FCC catalyst is removed from said stripping vessel, passes through a secondary stripping vessel, and is transferred from said secondary stripping vessel to said regeneration zone.

* * * * *